US011098876B2

(12) United States Patent
Gou

(10) Patent No.: US 11,098,876 B2
(45) Date of Patent: Aug. 24, 2021

(54) LED DECORATIVE LAMP

(71) Applicant: Jie Gou, Shenzhen (CN)

(72) Inventor: Jie Gou, Shenzhen (CN)

( * ) Notice: Subject to any disclaimer, the term of this patent is extended or adjusted under 35 U.S.C. 154(b) by 0 days.

(21) Appl. No.: 17/103,893

(22) Filed: Nov. 24, 2020

(65) Prior Publication Data

US 2021/0156541 A1 May 27, 2021

(30) Foreign Application Priority Data

Nov. 26, 2019 (CN) ..... 201911174950.5

(51) Int. Cl.

| | |
|---|---|
| ***F21V 31/00*** | (2006.01) |
| ***F21V 7/16*** | (2006.01) |
| *F21Y 103/33* | (2016.01) |
| *F21Y 115/10* | (2016.01) |
| *A43B 3/00* | (2006.01) |
| *F21W 121/06* | (2006.01) |

(52) U.S. Cl.

CPC ..... *F21V 7/16* (2013.01); *F21V 31/005* (2013.01); *A43B 3/001* (2013.01); *F21W 2121/06* (2013.01); *F21Y 2103/33* (2016.08); *F21Y 2115/10* (2016.08)

(58) Field of Classification Search

CPC ..... F21V 7/16; F21V 31/005; F21W 2121/00; A43B 3/001

See application file for complete search history.

(56) References Cited

U.S. PATENT DOCUMENTS

| | | | | |
|---|---|---|---|---|
| 7,029,152 | B1 * | 4/2006 | Kuhl | B60Q 1/26 362/489 |
| 8,475,020 | B2 * | 7/2013 | Dubosc | F21S 43/30 362/517 |
| 9,121,564 | B2 * | 9/2015 | Buisson | F21V 7/0025 |
| 2003/0026171 | A1 * | 2/2003 | Brewer | G04G 17/08 368/82 |
| 2018/0149346 | A1 * | 5/2018 | Rapisarda | F21V 23/045 |
| 2020/0116341 | A1 * | 4/2020 | Lin | A43C 11/1493 |

* cited by examiner

*Primary Examiner* — Arman B Fallahkhair

(57) ABSTRACT

An LED decorative lamp includes a support frame, a light source, and a bendable reflection assembly. The support frame is a hollow annular structure. The light source is used to emit light and is arranged in the support frame. The bendable reflection assembly is used to reflect light from the light source and is arranged on the support frame and connected to the light source.

4 Claims, 2 Drawing Sheets

LED DECORATIVE LAMP

CROSS REFERENCE TO RELATED APPLICATIONS

This application claims priority to Chinese Patent Application No. CN201911174950.5, filed Nov. 26, 2019, which is hereby incorporated by reference herein as if set forth in its entirety.

TECHNICAL FIELD

The present disclosure relates to decorative lamps, in particular to an LED decorative lamp.

BACKGROUND

Light emitting diode (LED) lamps have been widely used in various applications. Some conventional LED decorative lamps (e.g., shoe lamps) usually include several individual LEDs or a dot matrix LED composed of a flexible board. The pattern effect of the individual LEDs is ordinary. The manufacturing process of the dot-matrix LED is complicated and its cost is high.

Therefore, there is a need to provide a decorative lamp to overcome the above-mentioned problems.

BRIEF DESCRIPTION OF DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
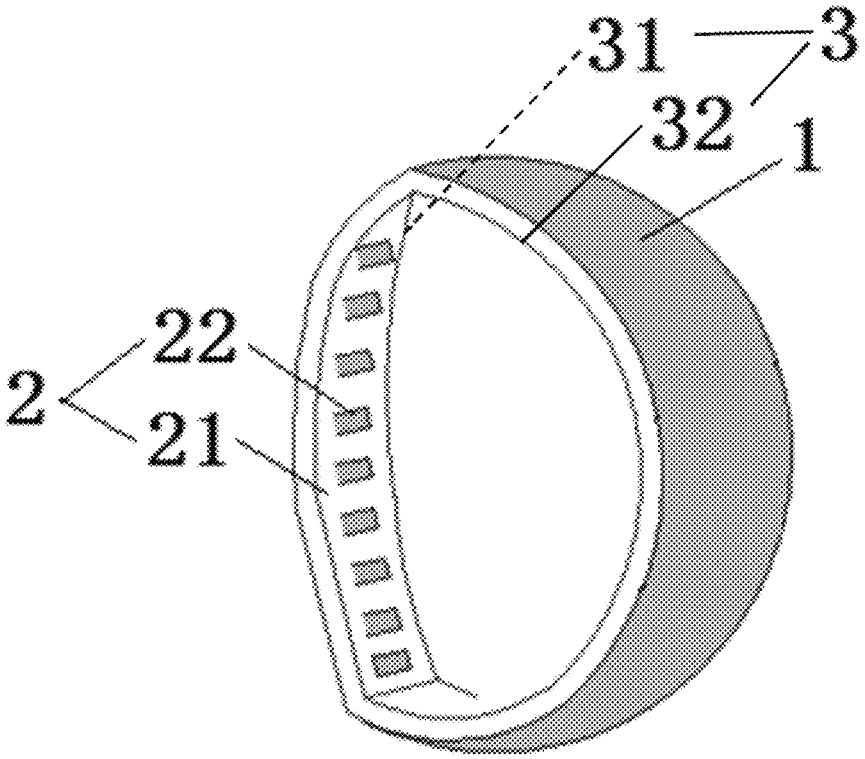
FIG. 1 is a perspective view of an LED decorative lamp according to one embodiment.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

With reference to FIG. 1, in one embodiment, an LED decorative lamp includes a support frame 1 that may be a hollow annular structure, a light source 2 that emits light and is arranged in the support frame 1, and a bendable reflection assembly 3 that is used for reflecting light from the light source 2 and is arranged on the support frame. The light source 2 is connected to the reflection assembly 3. In one embodiment, the support frame 1 may be made of a PVC material, and the support frame 1 may be bendable. The support frame 1 may also be made of a flexible material, a semi-rigid material, or a bendable material.

It should be noted that the light source 2 is arranged in the support frame 1, and the light source 2 is used for realizing the light emission of the LED decorative lamp. The reflection assembly 3 reflects the light emitted from the light source 2, thereby having an infinite LED light effect similar to that of a tunnel, which can improve the manufacturing process of the LED decorative lamp and reducing the cost.

As shown in FIG. 1, the light source 2 includes an LED lamp band 21 provided with a number of light emitting diodes (LEDs) 22. The LED lamp band 21 may be annular.

As shown in FIG. 1, the reflection assembly 3 includes a first semi-transmissive mirror 31 disposed at one end of the support frame 1 and a second semi-transmissive mirror 32 disposed in the support frame 1. The first semi-transmissive mirror 31 and the second semi-transmissive mirror 32 are both used for reflecting light from the light source 2.

In one embodiment, both the first semi-transmissive mirror 31 and the second semi-transmissive mirror 32 are flexible, and are made of a flexible material or a bendable reflective material.

As shown in FIG. 1, a seal is formed between the support frame 1 and the first semi-transmissive mirror 31, and between the support frame 1 and the second semi-transmissive mirror 32 such that the connection between the support frame 1 and the first semi-transmissive mirror 31 and between the support frame 1 and the second semi-transmissive mirror 32 is seamless. In one embodiment, the seal may be epoxy or uv glue.

Figure 2:
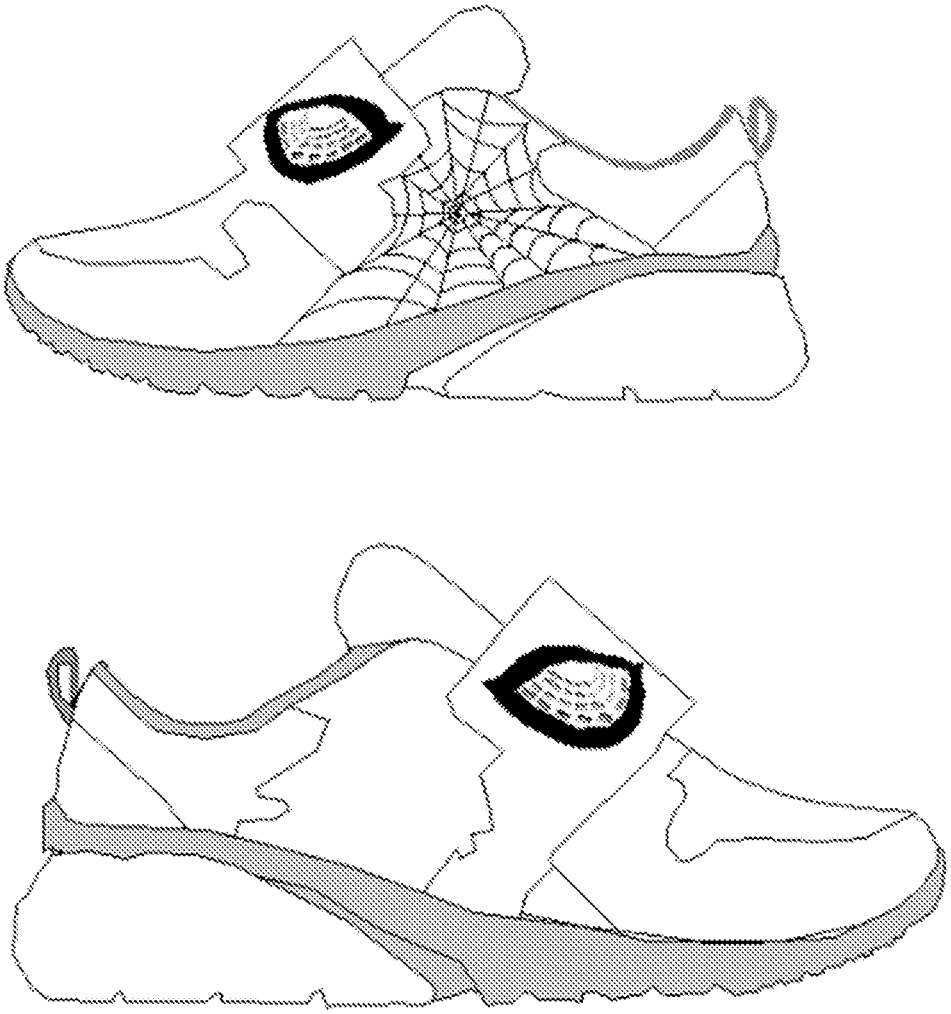
FIG. 2 is a schematic diagram showing the LED decorative lamp used in a shoe.

FIG. 2 is a schematic diagram showing the use of the LED decorative lamp according to one embodiment. The LED decorative lamp may be attached to a shoe to realize the effect that a plurality of patterns is infinitely extended. Decorative lamps can be bent to any shape and size, and completely waterproof, can be attached to any desired part of the shoe.

The operating principle of the lamp is as follows: The light source 2 is disposed in a support frame 1. The LED lamp band 21 is used to realize the light emission of the LED decorative lamp. The reflection assembly 3 acts as a reflecting element, and the light emitted from the light source 2 is reflected infinitely by the first semi-transmissive mirror 31 and the second semi-transmissive mirror 32, That is, after the light emitted from the light source 2 is incident on the first semi-transmissive mirror 31, the first semi-transmissive mirror 31 reflects the light to the second semi-transmissive mirror 32, the second semi-transmissive mirror 32 reflects the light back to the first semi-transmissive mirror 31, and the first semi-transmissive mirror 31 reflects the light back to the second semi-transmissive mirror 32 again. Through the repeatedly reflection, the infinite LED lighting effect similar to the tunnel appear. The manufacturing process of the LED decorative lamp is improved, and the cost is reduced.

The foregoing description, for purpose of explanation, has been described with reference to specific embodiments. However, the illustrative discussions above are not intended to be exhaustive or to limit the present disclosure to the precise forms disclosed. Many modifications and variations are possible in view of the above teachings. The embodiments were chosen and described in order to best explain the principles of the present disclosure and its practical applications, to thereby enable others skilled in the art to best utilize the present disclosure and various embodiments with various modifications as are suited to the particular use contemplated.

What is claimed is:

1. An LED decorative lamp used with a shoe comprising: a bendable support frame, wherein the bendable support frame is a hollow annular structure; a light source configured to emit light into a bendable reflection assembly, the light source arranged in the bendable support frame; and the bendable reflection assembly configured to reflect light from the light source, the bendable reflection assembly arranged on the support frame and connected to the light source, wherein the reflection assembly comprises a first semi-transmissive mirror arranged at one side of the support frame and a second semi-transmissive mirror arranged at the other side of the support frame, the first semi-transmissive mirror and the second semi-transmissive mirror are both configured to reflect light from the light source to have an infinite LED light effect as a tunnel; and a first connection between the support frame and the first semi-transmissive mirror and a second connection between the support frame and the second semi-transmissive mirror are sealed.

2. The LED decorative lamp according to claim 1, wherein the light source comprises an LED lamp band and a plurality of light emitting diodes that are arranged on the LED lamp band.

3. The LED decorative lamp according to claim 2, wherein the LED lamp band is curved.

4. The LED decorative lamp according to claim 1, wherein the sealed first and second connections are formed by epoxy resin or UV glue.

* * * * *